US005373954A

United States Patent [19]

Julian

[11] Patent Number: 5,373,954

[45] Date of Patent: Dec. 20, 1994

[54] TAMPER INDICATING CLOSURE

[75] Inventor: Randall K. Julian, Evansville, Ind.

[73] Assignee: Sunbeam Plastics Corporation, Evansville, Ind.

[21] Appl. No.: 250,652

[22] Filed: May 27, 1994

Related U.S. Application Data

[63] Continuation of Ser. No. 34,878, Mar. 19, 1993, abandoned.

[51] Int. Cl.[5] ..... B65D 41/34

[52] U.S. Cl. ..... 215/256; 215/252; 215/344

[58] Field of Search ..... 215/252, 254, 256, 344

[56] References Cited

U.S. PATENT DOCUMENTS

| | | | |
|---|---|---|---|
| 4,597,500 | 7/1986 | Stubbs | 215/256 |
| 4,919,286 | 4/1990 | Agbay, Sr. | 215/235 |
| 4,984,701 | 1/1991 | Margaria | 215/256 |
| 5,197,619 | 3/1993 | Margaria | 215/256 |
| 5,207,783 | 5/1993 | Burton | 215/256 |

FOREIGN PATENT DOCUMENTS

| | | | |
|---|---|---|---|
| 1479330 | 10/1968 | France | 215/256 |
| 580191 | 7/1958 | Italy | 215/256 |

*Primary Examiner*—Allan N. Shoap
*Assistant Examiner*—Stephen Cronin
*Attorney, Agent, or Firm*—Gifford, Groh, Sprinkle, Patmore and Anderson

[57] ABSTRACT

A tamper indicating closure has a tamper indicating band which is retained on a container by a container neck flange without the use of a cooperating bead or flange on the tamper indicating band. The retention is accomplished by providing a flexure at the bottom of the cap skirt which permits the band to move outwardly over and under the container flange. The closure can have a tear strip which provides the flexure on the closure.

14 Claims, 2 Drawing Sheets

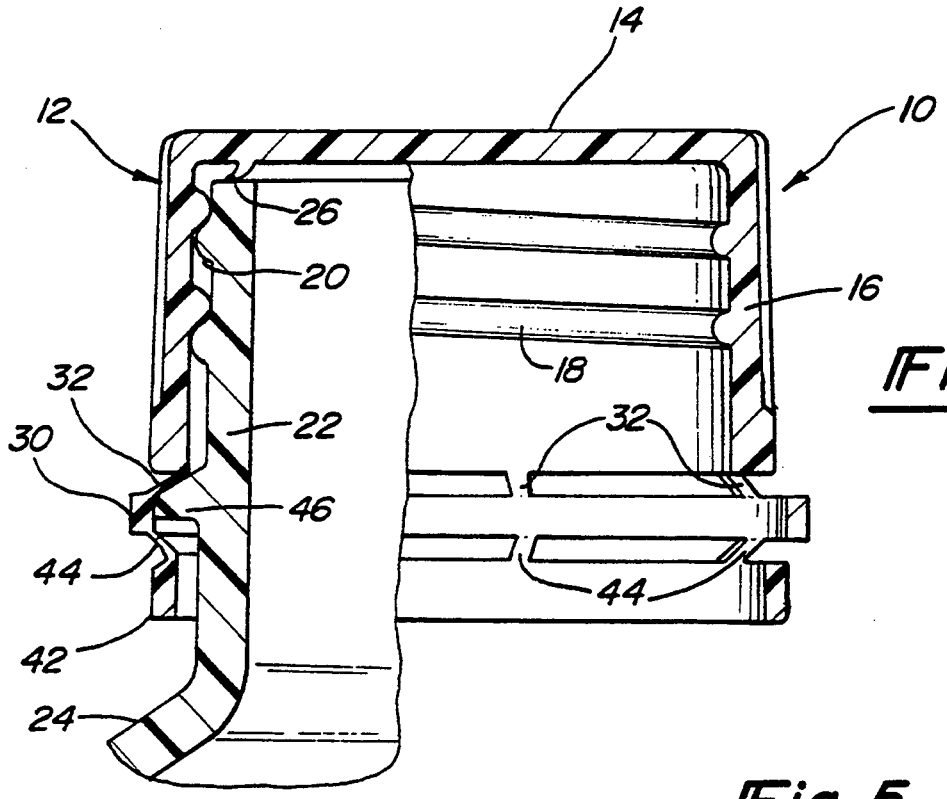
Fig-4
Fig-5
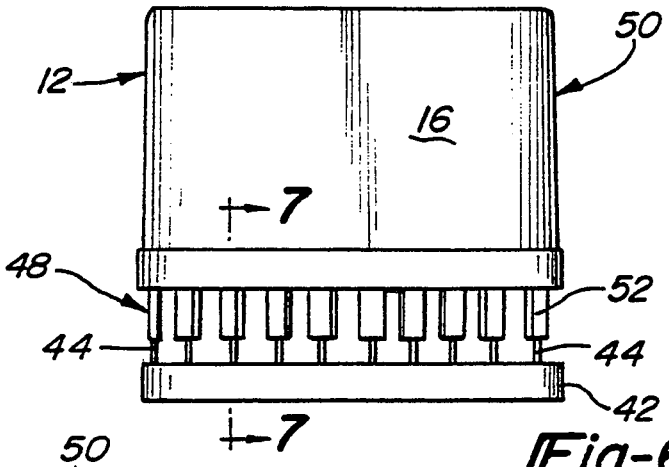
Fig-7
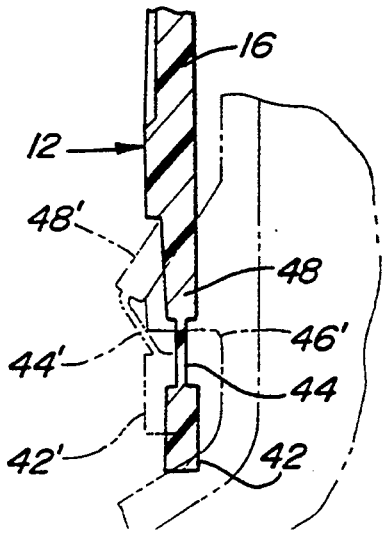
Fig-6
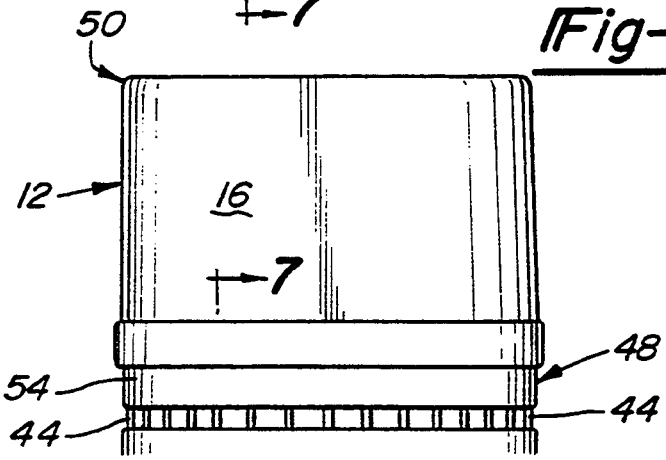

TAMPER INDICATING CLOSURE

This is a continuation of copending application Ser. No. 08/034,878 filed on Mar. 19, 1993 now abandoned.

BACKGROUND OF THE INVENTION

1. Field of the Invention

This invention relates to tamper indicating closures for application to container necks. The tamper indicating feature indicates that closure has been previously removed, or an attempt has been made to remove it from the container. More particularly, this invention relates to a tamper indicating closure in which a tamper indicating band depends from the bottom of the cap skirt by spaced frangible webs. When the cap has been threaded onto the container neck, the tamper indicating band is retained by a bead on the container neck. When the closure cap is unthreaded from the container neck, the tamper indicating band is restrained against axial movement by the container neck bead causing fracture of the frangible webs and separation of the band from the cap. In an alternative embodiment, a tear strip is interposed between the cap skirt and the tamper indicating band with frangible webs between the cap skirt and the tear strip and between the tear strip and the tamper indicating band. In order to remove the cap, the tear strip is first unwound and removed leaving the tamper indicating band on the container and allowing the cap to be removed by unthreading.

2. Description of the Related Art

In presently available tamper indicating band closures, the band is provided with an inwardly directed bead which coacts with an outwardly directed bead or flange on the container neck. In the process of threading the cap onto the container neck, the bead on the tamper indicating band snaps over the bead on the container neck. In the unthreading process, the band is restrained against axial motion by coaction between the bead on the tamper indicating band and the container bead so that the frangible webs between the bottom of the cap skirt and the top of the tamper indicating band are fractured. The inwardly directed bead on the tamper indicating band requires a complex mold design to remove the formed closure from the mold core.

SUMMARY OF THE INVENTION

The present invention provides a tamper indicating closure for use on a container having a threaded neck and an outwardly projecting bead below the thread. The closure has a tamper indicating band in which the conventional inwardly directed bead on the tamper indicating band has been eliminated, greatly simplifying the mold structure. The new closure includes a cap with a top and a depending annular skirt which has a thread for engaging the container neck thread. Flexure means is provided at the bottom of the annular skirt, and the tamper indicating band is connected to the bottom of the skirt by axially extending circumferentially spaced frangible webs. When the cap is threaded onto the container the flexible portion is bent radially outward by contact with the container bead, and the tamper indicating band moves radially inward under the container bead retaining the tamper indicating band on the container neck without the use of a bead on the tamper indicating band. The flexible portion can be provided by a variety of structures. For example, the bottom of the cap skirt can be made thin so that it bends or flexes outwardly as it passes over the container bead in the process of threading the closure onto the container neck.

In another embodiment, the flexible or flexure portion includes circumferentially spaced ribs with the frangible webs being connected to the bottom of the ribs and to the tamper indicating band.

In another embodiment of the invention, a tear strip is connected to the annular skirt with circumferentially spaced upper frangible webs and the tamper indicating band is connected to the tear strip by circumferentially spaced lower frangible webs. The tear strip acts as the flexure, bending outwardly as it passes over the container neck bead allowing the tamper indicating band to move inwardly under the bead for retention.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 4 is an elevational view in cross section showing a portion of the container neck as the closure is completely threaded onto the container neck;

FIG. 5 is an elevational view of another embodiment of the invention;

FIG. 6 is an elevational view similar to FIG. 5 showing still another embodiment of the invention; and FIG. 7 is a partial elevational view in cross section taken along line 7—7 of FIGS. 5 and 6 and also showing in phantom the application of the closure to the container neck.

DETAILED DESCRIPTION OF THE PREFERRED EMBODIMENTS OF THE INVENTION

Figure 1:
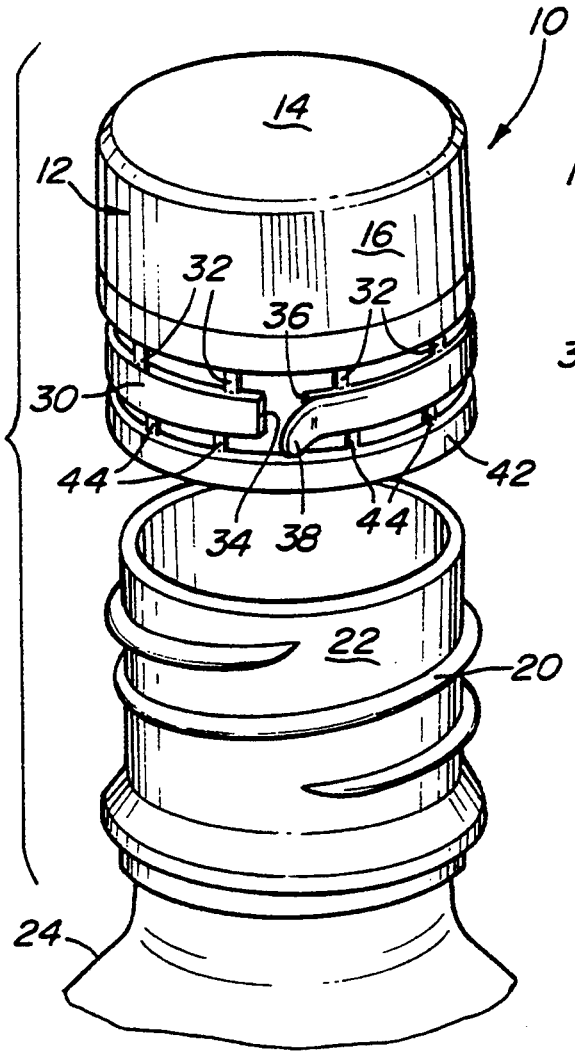
FIG. 1 is an exploded perspective view of the closure of this invention as it will be applied to a standard container neck.

Referring to FIGS. 1–4, the closure 10 of this invention is shown in a tear strip embodiment. The closure 10 includes a cap 12 having a top 14 and an annular skirt 16 depending from the periphery of the top. The skirt has internal threads 18 which engage the external threads 20 on the neck 22 of container 24. An annular sealing fin 26 depends from the cap top 14 to make sealing contact with the lip 28 of the container neck 22 when the closure is fully threaded onto the container neck.

Figure 3:
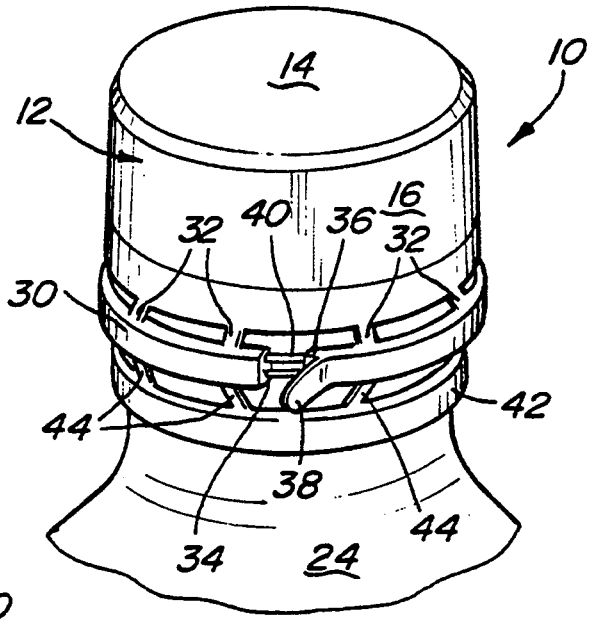
FIG. 3 is a perspective view of the closure having been fully threaded onto the container neck.
Figure 2:
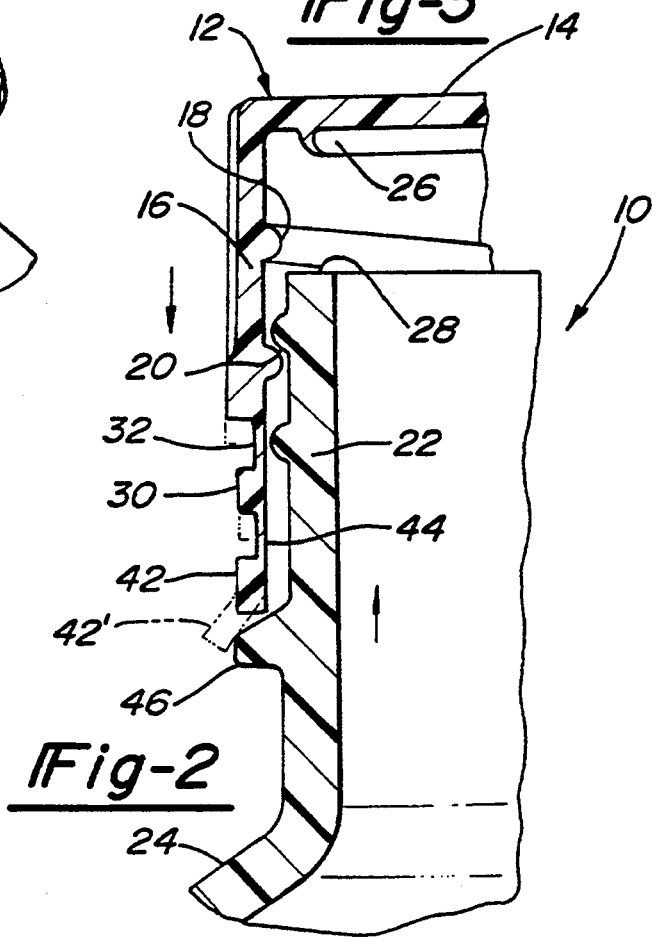
FIG. 2 is a partial elevational view in cross section showing the closure in its initial stage of being applied to the container neck.

A tear strip 30 is attached to the bottom of the cap skirt 16 by spaced frangible webs 32. The strip 30 extends around a substantial portion of the annular skirt 16 having adjacent ends 34 and 36 with a gripping tab 38 formed at one of the ends 36. As seen in FIG. 1, the ends 34 and 36 are spaced from each other with no connection between them. In another embodiment, the ends 34 and 36 can be joined by circumferentially extending frangible webs 40 as shown in FIG. 3. Likewise, if desired, the band can be continuous with a frangible connection in the form of an axial line of weakening being provided adjacent to the pull tab 38.

A tamper indicating band 42 is attached to the bottom of the tear strip 30 by frangible webs 44. As can best be seen in FIG. 2, the tamper indicating band does not have an inwardly projecting bead to cooperate with the container neck bead or flange 46, and, in fact, the internal surfaces of the frangible webs 32 and 44 are aligned with each other and are aligned with the internal surface of the cap skirt 14 and the internal surfaces of the tear band 30 and tamper indicating band 42. This allows the closure to be easily ejected from a simple mold.

As also seen best in FIG. 3, as the closure 10 is applied to the container neck, the tamper indicating band is first flexed radially outward as shown in phantom at 42' by its contact with the container flange 46. As the closure is further threaded onto the container neck as shown in FIGS. 3 and 4, The tear strip 30 is bent or flexed radially outwardly as it passes over the container flange 46 allowing the tamper indicating band 42 to snap radially inward underneath the container flange 46 to be retained by this flange. At its fully closed position, the tamper indicating band 42 is returned to its as molded position with the tear strip 30 being maintained in its outwardly flexed position and the tear strip in effect becomes the flexure portion at the bottom of the cap skirt 16. In some instances an axially extending release slot can be provided in the tear strip to facilitate the outward flexure of the tear strip 30.

When the closure 10 is to be first removed from the container neck 22, the pull tab 38 is grasped in the user's fingers and the strip 30 is unwound. The frangible connection between the tear strip ends 34 and 36 will first be broken, if such a connection is provided, and then the frangible webs 32 and 44 will be sequentially broken. When the tear strip has been completely removed, the tamper indicating band 42 remains on the container neck 22 when the cap is unthreaded and removed.

The frangible webs 32 and 44 can be appropriately sized so that an adult can also open the container 24 by unthreading the cap portion 12 of the closure 10. The initial unthreading will bring the tamper indicating band 42 into firm contact with the bottom of the container flange 46 so that it will be retained there as the frangible webs 32 and 44 are stretched to their breaking point. With this arrangement, the adult user can elect merely to unthread the cap or to remove the tear strip before unthreading the cap. In the case of an arthritic user, the convenience of the tear strip will normally be used.

In the closure 50 shown in FIGS. 5–7, the tear strip 30 has been omitted, and its function as a flexure portion at the bottom of the cap skirt has been replaced by a flexure portion 48. In the embodiment of FIG. 5 circumferentially spaced, axially extending ribs 52 provide the flexure portion 48. The tamper indicating band 42 is attached to the bottom of the ribs 52 by frangible webs 44. In the embodiment of FIG. 6, the flexure portion 48 is a thinner skirt portion 54. As best seen in FIG. 7, as the cap 12 is threaded onto the container neck, the flexure portion 48 is flexed outwardly as shown in phantom at 48' along with the frangible webs shown at 44' by contact with the container flange shown at 46' so that the tamper indicating band shown at 42' seats underneath the flange 46'. When the closure 50 is unthreaded, the tamper indicating band 42 is retained by the container flange so that the frangible webs 44 are stretched to their breaking point allowing the cap 12 to be removed while the band 42 remains on the container neck.

The embodiments of the invention in which an exclusive property is claimed are defined as follows:

1. A tamper indicating closure for use on a container having a threaded neck and an outwardly projecting bead below the thread, said closure comprising:

a cap with a top and a depending annular skirt having an internal diameter with an inwardly projecting thread for engaging the container neck thread;

flexure means allowing radially outward bending at the bottom of said annular skirt;

a tamper indicating band connected to the bottom of said annular skirt by a plurality of axially extending circumferentially spaced frangible webs; said flexure means, tamper indicating band and frangible webs having internal diameters at least as large as the internal diameter of said annular skirt; and wherein as said cap is threaded onto said container neck, said flexure means is bent radially outward by contact with said container bead, and said tamper indicating band moves radially inward under said container bead, retaining said tamper indicating band on said container neck.

2. The closure according to claim 1 wherein said flexure means includes a plurality of circumferentially spaced ribs, and said frangible webs extend from the bottom of said ribs to said tamper indicating band.

3. The closure according to claim 1 wherein an upper portion of said annular skirt contains said thread and a lower, thinner annular skirt portion extends below said bead when said threads are engaged and said closure is in a closed condition on said container, said lower, thinner annular skirt portion forming said flexure means.

4. The closure according to claim 1 wherein said flexure means includes a tear strip.

5. The closure according to claim 4 wherein said tear strip is connected to said annular skirt by a plurality of circumferentially spaced upper frangible webs, and said tamper indicating band is connected to said tear strip by a plurality of circumferentially spaced lower frangible webs.

6. The closure according to claim 5 wherein said upper and lower frangible webs are sized so that the cap can be unthreaded from the container fracturing the upper and lower frangible webs and leaving the tamper indicating band retained on the container neck, and the cap can also be removed by unwinding the tear strip and removing the tear strip from the closure before unthreading the cap from the container neck, leaving the tamper indicating band retained on the container neck.

7. The closure according to claim 5 wherein said tear strip extends around a substantial portion of said annular skirt.

8. The closure according to claim 7 wherein said tear strip has adjacent ends, one of which has a radially extending finger gripping tab.

9. The closure according to claim 8 wherein the adjacent ends of said tear strip are joined by a frangible connection.

10. The closure according to claim 9 wherein said frangible connection includes a circumferentially extending frangible web.

11. The closure according to claim 7 wherein said upper and lower frangible webs have aligned inner surfaces and these aligned inner surfaces of the webs are aligned with inner surfaces of said annular cap skirt, tear strip, and tamper indicating band.

12. The closure according to claim 1 including a sealing ring depending from said cap top which seals against the container neck.

13. A tamper indicating closure for use on a container having a threaded neck and an outwardly projecting bead below said thread, said closure comprising:

a cap with a top and a depending annular skirt having an internal diameter with an inwardly projecting thread for engaging the container neck thread;

a tear strip connected to said skirt by a plurality of circumferentially spaced upper frangible webs;

a tamper indicating band connected to said tear strip by a plurality of circumferentially spaced lower frangible webs;

said tear strip, upper frangible webs, lower frangible webs and tamper indicating band having internal diameters at least as large as the internal diameter of said annular skirt; and wherein as said cap is threaded onto said container neck, said upper and lower frangible webs allow said tear strip to bend radially outward as it is contacted by said container bead, and said tamper indicating band moves radially inward under said container bead, retaining said tamper indicating band on said container neck.

14. The closure according to claim 13 wherein said upper and lower frangible webs are sized so that the cap can be unthreaded from the container fracturing the upper and lower frangible webs and leaving the tamper indicating band retained on the container neck, and the cap can also be removed by unwinding the tear strip and removing the tear strip from the closure before unthreading the cap from the container neck, leaving the tamper indicating band retained on the container neck.

* * * * *